United States Patent [19]

Govaer et al.

[11] 4,202,525

[45] May 13, 1980

[54] WATER CONTROL DEVICE FOR FLUSH VALVES

[75] Inventors: Louis E. Govaer, Hayward; James E. Hobbs, Pleasanton, both of Calif.

[73] Assignee: Chemworld Corporation, Hayward, Calif.

[21] Appl. No.: 875,204

[22] Filed: Feb. 6, 1978

[51] Int. Cl. ..... F16K 31/145; E03D 3/06

[52] U.S. Cl. ..... 251/40

[58] Field of Search ..... 251/35, 40, 42

[56] References Cited

U.S. PATENT DOCUMENTS

| | | | |
|---|---|---|---|
| 2,066,086 | 12/1936 | Wilson | 251/40 |
| 2,734,712 | 2/1956 | Fraser | 251/35 |
| 2,776,812 | 1/1957 | Colendar | 251/40 |
| 3,399,860 | 9/1968 | Billeter et al. | 251/40 |

FOREIGN PATENT DOCUMENTS

| | | | |
|---|---|---|---|
| 131048 | 3/1951 | Sweden | 251/40 |

*Primary Examiner*—Martin P. Schwadron
*Assistant Examiner*—G. L. Walton
*Attorney, Agent, or Firm*—Robert Charles Hill

[57] ABSTRACT

A flush valve having a diaphragm type main valve and a relief valve located between the main valve and a cover member and a ring shaped water control device located between the relief valve and the cover member to shorten the flush cycle and greatly reduce the total volume of water flow through the main valve during flushing.

8 Claims, 4 Drawing Figures

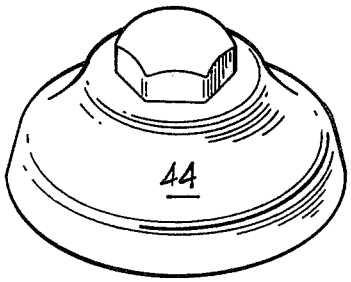
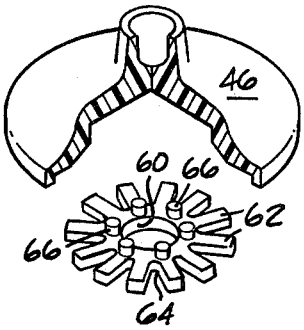
FIGURE 2.
FIGURE 3.
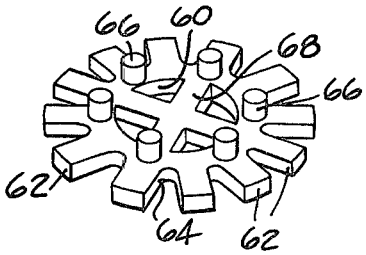
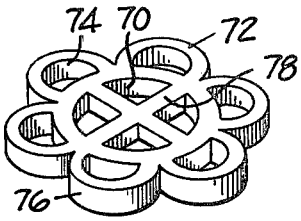
FIGURE 4.
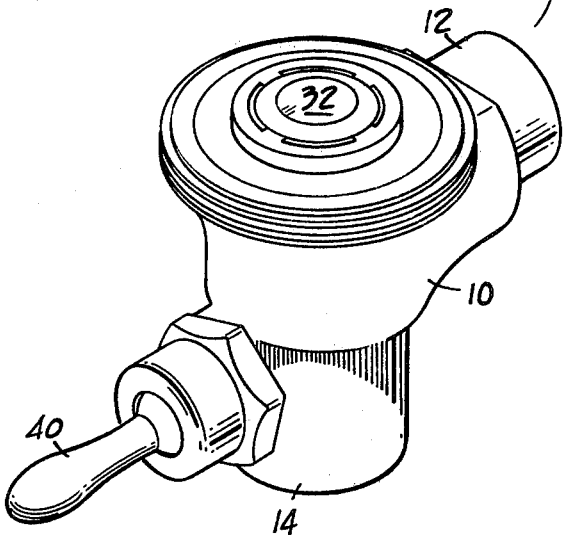
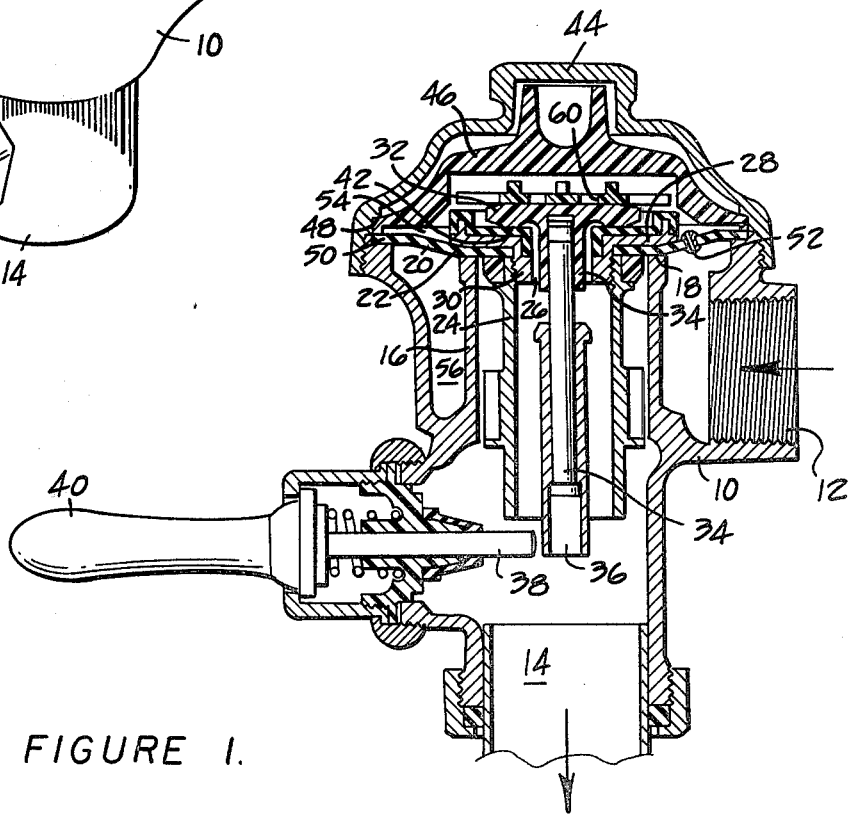
FIGURE 1.

WATER CONTROL DEVICE FOR FLUSH VALVES

BACKGROUND OF THE INVENTION

This invention relates to a water control device for flush valves. The invention is more particularly directed to a water control device for flush valves of the type used in toilet fixtures such as the well-known Sloan Flush Valve.

Due to the extreme water shortages brought on by the drought conditions in the western states during the past several years, strict water rationing measures have been taken by the various governmental agencies controlling the dwindling water supplies. For example, in northern California many communities have reduced the allowable rate of water consumption in homes to as little as 40 to 50 gallons per day. Stiff penalties in the form of heavy monetary fines for overusage, and water shut-off measures for repeated offenders, have forced water users to take drastic steps to conserve water usage. Since 45% of the water usage (excluding industrial use) is for the flushing of toilets (average toilet flushing consumes 5–7 gallons of water), this area has been given major attention. For tank type toilets used in the average home, displacement devices such as bottles or aluminum cans filled with pebbles, etc., have been used.

However, perhaps the greatest problems have been incurred by governmental agencies, businesses and hotels, most of which use the well-known Sloan Flush Valve for toilets rather than the displacement tank type commonly used in homes. Excessive water usage by these entities has resulted in huge fines often amounting to thousands of dollars per month.

The water control device of the present invention shortens the flush cycle of a Sloan Flush Valve and thereby greatly reduces the volume of water flow during flushing.

OBJECTS OF THE INVENTION

It is the primary object of the present invention to provide a new and improved water control device which greatly reduces the volume of water consumed in flushing.

Another object is to provide structure which is inexpensive to manufacture and long lasting in usage.

Other objects, novel features and advantages of the present invention will become apparent upon making reference to the following detailed description and the accompanying drawings. The description and drawings will also further disclose the characteristics of this invention, both as to its structure and mode of operation. Although preferred embodiments of the invention are described hereinbelow, and shown in the accompanying drawing, it is expressly understood that the descriptions and drawings thereof are for the purpose of illustration only and do not limit the scope of this invention.

BRIEF DESCRIPTION OF THE DRAWINGS

FIG. 1 is a cross-sectional view of a flush valve showing therein the water control device of the present invention.

FIG. 2 is an exploded view showing the details of the invention and its spacial orientation with respect to the remainder of the flush valve.

FIG. 3 is a perspective view of one embodiment of the water control device of the present invention.

FIG. 4 is a perspective view of another embodiment of the water control device of the present invention.

DESCRIPTION OF THE PREFERRED EMBODIMENT

Referring specifically to FIG. 1, the general details of construction and operation of the flush valve are well-known and need not be pointed out specifically, except as they are concerned with the present invention. The flush valve includes the brass body 10 provided with an inlet water supply connection 12 and an outlet 14 between which there is an internal upstanding barrel 16. The upper edge portion of barrel 16 forms the annular main valve seat 18. The main valve member consists of a flexible circular rubber diaphragm 20 having a bottom valve seating portion 22 and which is clamped to the top end of a cylindrical guide member 24, made of plastic material such as CYCOLAC, extending downward within the barrel 16. The diaphragm 20 is provided with a central opening 26 through which a clamping disc 28 extends with a portion 30 threaded into the guide member 24 and thereby clamps the diaphragm 20 tightly between them. Certain other details of the diaphragm 20 are preferably constructed in accordance with U.S. Pat. No. 3,656,499 issued Apr. 18, 1972. A relief valve 32 which may be made of DELRIN plastic material is carried by the clamping disc 28 and has a depending operating stem 34 which extends downward through the diaphragm opening 20 and within the guide member 24. The lower end 36 of the stem may be made of DELRIN plastic material and is arranged opposite the actuating plunger 38 which is adapted to be pushed inward by the handle operator 40 to tilt the relief valve 32 off its seat 42 across the opening 26 to initiate the operation of the flush valve.

The valve body 10 is provided with an external cover 44 and an internal cover 46, the latter preferably being made of an ABS plastic molded material such as CYCOLAC. The external cover 44 is screw threaded around the top end of the body 10 and provided with a shoulder 48 which engages the outer peripheral edge of internal cover 46 and presses it downwardly against the thickened edge 50 of the diaphragm 20 to clamp the diaphragm firmly around its periphery into position in the valve body.

In the ordinary operation of the flush valve described, the water pressures are equalized above and below the diaphragm 20 through the small by-pass opening 52, and since the pressure area above the diaphragm in chamber 54 is greater than that below the diaphragm in chamber 56, the diaphragm is held tightly against valve seat 18, thereby shutting off the water flow between the inlet 12 and outlet 14. Now when the plunger 38 is pushed inward by the operating handle 40 to contact stem 36, the relief valve 32 is tilted from its seat 42, so that the pressure above the diaphragm in chamber 54 is relieved downward through the diaphragm central opening 26 to the outlet 14. The water pressure from the inlet 12 is now effective to flex and lift the diaphragm upward from its seat 18 and permit the water flow to take place through the flush valve and over the top end of the barrel 16 to the outlet 14 and into the plumbing fixture.

The lower end 36 depending from stem 34 enables the relief valve 32 to close upon its seat 42, in the event the handle 40 is held unduly long in the operated position. With the relief valve again seated, the upper chamber 54 gradually fills to the inlet pressure value through by-pass 52, thereby timing the length of the flushing action and the amount of water passing through the valve, until the diaphragm 20 is again seated on the main seat 18, shutting off the water flow.

In the present invention, a water control means 60 is positioned between the relief valve 32 and the internal cover 46. The water control device 60 limits the height to which the relief valve 32 can rise or tilt off its seat 42 actuated by the plunger 38. This serves to shorten the flush cycle and greatly reduces the total volume of water flow through the main valve during flushing.

The water control means 60 is generally ring shaped and is preferably made of a suitable plastic material. A plastic material is preferred because it is relatively stable under all conditions, is non-corrosive, resists wear, inhibits the formation of foreign particles on its surface, and is economical and easy to manufacture. All these features render this water control device eminently suitable for the use to which it is put.

In the embodiment shown in FIGS. 2 and 3, the ring shape water control device 60 is provided with spoke-like projections 62 about its entire periphery and a series of generally V-shaped notches 64 between the spokes. This construction ensures proper water flow into the upper chamber 54 when the relief valve 32 is tilted off its seat 42. A series of disc shaped knobs 66 are provided on the upper surface of the ring 60 adjacent the inner periphery thereof. These knobs help ensure that the ring 60 will not become cocked and wedged between the inner cover 46 and the relief valve 32. Interior support members 68 can be provided to supply additional strength to the device 60.

It should be understood that the height of the knobs 66 can vary depending upon the water pressure. When the water pressure is not at full strength, such as on the top floors of tall buildings, then the knobs 66 can be somewhat shorter. This can be accomplished by trimming off or grinding down the excess portion of the knob 66.

In the embodiment shown in FIG. 4, the outer periphery of the ring shaped water control device 70 is provided with a series of smooth, rounded scalloped projections 72. Each scalloped projection is provided with an opening 74 through which water may easily flow into the upper chamber 54 when the relief valve 32 is tilted off its seat 42. The smooth rounded edges 76 of the scallops 72 prevent the ring 70 from wedging or becoming jammed between the inner cover 46 and the relief valve 32. Interior support members 78 can be provided to supply additional strength to the device 70.

It will be obvious that numerous modifications and variations are possible for the above described water control device within the scope of the present invention. The foregoing description, as setting forth various constructional and operational details for purposes of understanding only, is not to be taken as limiting the scope of the present invention which is defined only by the following claims.

I claim:

1. In a flush valve having inlet and outlet water passages:

an upstanding barrel portion in said flush valve having a main valve seat around the top end thereof, a flexible diaphragm having a central opening therein surrounded by a main valve seating portion, a cylindrical hollow guide member depending from said diaphragm and extending through said barrel portion, a relief valve seatable across the diaphragm opening and having an operating stem depending through said guide member, an internal cover member positioned above said relief valve and spaced therefrom, means for operating said relief valve to cause said diaphragm to open from said main valve seat and permit water flow through said flush valve, and free floating water control means positioned immediately above said relief valve and in between said relief valve and said cover member whereby the height to which the relief valve can rise is reduced and the water flow cycle is shortened.

2. A flush valve as set forth in claim 1 wherein said water control means positioned immediately above said relief valve is generally ring shaped having a series of spoked projections about the outer periphery thereof, and a series of notched out portions between each of said spoked projections.

3. A flush valve as set forth in claim 2 wherein said ring shaped water control device is provided with a series of knobs on the inner periphery thereof and located on the side of said ring which is adjacent the internal cover member.

4. A flush valve as set forth in claim 3 wherein said knobs are in the form of solid discs.

5. A flush valve as set forth in claim 2 having at least one interior support member.

6. A flush valve as set forth in claim 3 wherein the height of the knobs can vary depending upon the pressure of the water.

7. A flush valve as set forth in claim 1 wherein said water control means is generally ring shaped and has a series of smooth, rounded, scalloped projections about the outer periphery thereof, and wherein each scalloped projection is provided with an opening therethrough.

8. A flush valve as set forth in claim 5 having at least one interior support member.

* * * * *